US005798771A

United States Patent [19]

Nishii et al.

[11] Patent Number: 5,798,771

[45] Date of Patent: Aug. 25, 1998

[54] IMAGE RECORDING METHOD AND APPARATUS

[75] Inventors: Teruyuki Nishii, Yokohama; Norio Sugiyama, Fujisawa, both of Japan

[73] Assignee: Canon Kabushiki Kaisha, Tokyo, Japan

[21] Appl. No.: 885,960

[22] Filed: Jun. 30, 1997

Related U.S. Application Data

[63] Continuation of Ser. No. 301,594, Sep. 7, 1994, abandoned.

[30] Foreign Application Priority Data

Sep. 13, 1993 [JP] Japan ..... 5-226873
Jul. 6, 1994 [JP] Japan ..... 6-154450

[51] Int. Cl.[6] ..... B41J 2/195

[52] U.S. Cl. ..... 347/7; 547/19

[58] Field of Search ..... 347/3, 5, 7, 15, 347/19; 358/296, 401, 437, 439, 501

[56] References Cited

U.S. PATENT DOCUMENTS 4,449,052 5/1984 Krieg ..... 347/19
5,068,806 11/1991 Gatten ..... 395/113
5,132,711 7/1992 Shinada et al. ..... 347/6
5,353,052 10/1994 Suzuki et al. ..... 347/19
5,357,347 10/1994 Hirose et al. ..... 347/3
5,387,976 2/1995 Lesniak ..... 347/19
5,402,246 3/1995 Seitz et al. ..... 358/299
5,481,374 1/1996 Tachibana et al. ..... 358/444
5,488,395 1/1996 Takayanagi et al. ..... 347/7

FOREIGN PATENT DOCUMENTS 3247456 11/1991 Japan ..... 347/7
5-220973 8/1993 Japan ..... 347/7

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

When a received image is printed out in a facsimile apparatus, it is determined whether ink remains in an ink tank. If no ink remains, the image is reduced in size and is printed out upon adding a footer mark thereto. The recorded density of the footer mark is sensed by a photosensor and it is judged that there is too little ink left for printing if the detected density is less than a predetermined level. Thus, the footer mark is added on and sensed only when there is very little ink remaining. This eliminates the need for reducing the size of the image unnecessarily and therefore prevents a deterioration in image quality. Furthermore, since whether or not there is actually any ink left for printing is detected, no longer will an ink tank still containing some ink be replaced unnecessarily. This prevents ink from being wasted.

33 Claims, 14 Drawing Sheets

IMAGE RECORDING METHOD AND APPARATUS

This application is a continuation of application No. 08/301,594 filed Sept. 7, 1994 now abandoned.

BACKGROUND OF THE INVENTION

1. Field of the Invention

This invention relates to an image recording apparatus such as a facsimile apparatus for recording an image by the ink-jet method, as well as to an image recording method.

2. Description of the Related Art

Some image recording apparatus such as facsimile machines in which recording is carried out by the ink-jet method do not come equipped with means for detecting the amount of remaining ink. In such apparatus, the output image is reduced in size before being recorded, a pattern referred to as a "footer mark" is recorded on the trailing edge of the recording paper in the blank area produced by reduction of the image and detection of the remaining amount of ink is performed by checking whether the footer mark could be detected or not.

Some ink-jet recording apparatus have means for detecting the amount of remaining ink. Specifically, a sensor is provided on the ink cartridge and functions to sense the amount of ink remaining.

However, with the apparatus in which the amount of remaining ink is detected by detecting the footer mark, the reduced image is always recorded irrespective of the amount of ink remaining. Consequently, there is always some deterioration in image quality.

Another drawback is that consumption of ink is hastened by the recording of the footer mark.

Further, with the apparatus in which the amount of remaining ink is sensed by the sensor, contamination of the sensor, movement of the ink cartridge or a shift in the mounting position of the sensor can cause ink depletion to be sensed even though ink still remains. Thus, detection accuracy is poor.

SUMMARY OF THE INVENTION

The present invention has been devised in view of the foregoing problems and its object is to provide an improved image recording apparatus and method as well as an improved facsimile apparatus.

Another object of the present invention is to provide an image recording apparatus and method as well as a facsimile apparatus, in which it is possible to reduce consumption of ink when detecting remaining amount of ink.

A further object of the present invention is to provide an image recording apparatus and method as well as a facsimile apparatus, in which depletion of ink can be detected highly accurately and a deterioration in image quality due to use of ink in detection of remaining amount of ink can be prevented.

In order to attain the foregoing objects, the present invention provides an image recording apparatus and method as well as a facsimile apparatus in which it is detected whether there is any stored ink remaining and a prescribed pattern is added to a prescribed position of an input image in dependence upon whether or not ink is detected, after which the image is outputted. The resulting image, which will or will not have the additional prescribed pattern, is printed, and the recorded density of the prescribed pattern on the printed image having the pattern is sensed. The remaining amount of ink is detected in accordance with the recorded density.

In a preferred embodiment, the printing of the image is performed by jetting ink from a recording head.

In a preferred embodiment, the image is printed upon being received from an external device.

In another preferred embodiment, it arranged so that when there is no ink remaining, the image is stored in memory until printing ends normally.

In another preferred embodiment, the prescribed pattern is obtained by converting the resolution of the input image, reducing the image and then forming the reduced image in a blank portion.

In another preferred embodiment, the recording density of the prescribed pattern is detected optically.

In another preferred embodiment, whether or not there is any stored ink remaining is detected by counting the number of droplets jetted, comparing a count value obtained by storing ink storage volume as number of droplets with the count of ink droplets counted, and detecting whether or not there is any stored ink remaining based upon results of the comparison.

In another preferred embodiment, whether or not there is any stored ink remaining is detected by measuring electrical conductivity of the ink.

In another preferred embodiment, the prescribed pattern is formed as a rectangular black pattern in the vicinity of the corner of a recording medium on which an image is printed.

In another preferred embodiment, printing is performed by applying thermal energy to the ink to form air bubbles in the ink and jetting the ink by causing the air bubbles to act upon the ink.

In another preferred embodiment, a display to the effect that there is no ink remaining is presented when this fact is detected.

In another preferred embodiment, depletion of ink is detected in a state in which a slight amount of ink remains.

In accordance with the present invention arranged as described above, a footer mark is outputted and detected and depletion of ink is sensed on the basis of the results of comparing ink storage capacity and amount of ink already jetted. This makes it possible to sense ink depletion accurately. Moreover, it is no longer necessary to add the footer mark to all output images.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4 is a diagram showing an example of an ordinary printed output and example of a printed output in a case where a footer mark has been added on;

DESCRIPTION OF THE PREFERRED EMBODIMENTS

[First Embodiment]

A first embodiment of the present invention will now be described with reference to the drawings.

Figure 1:
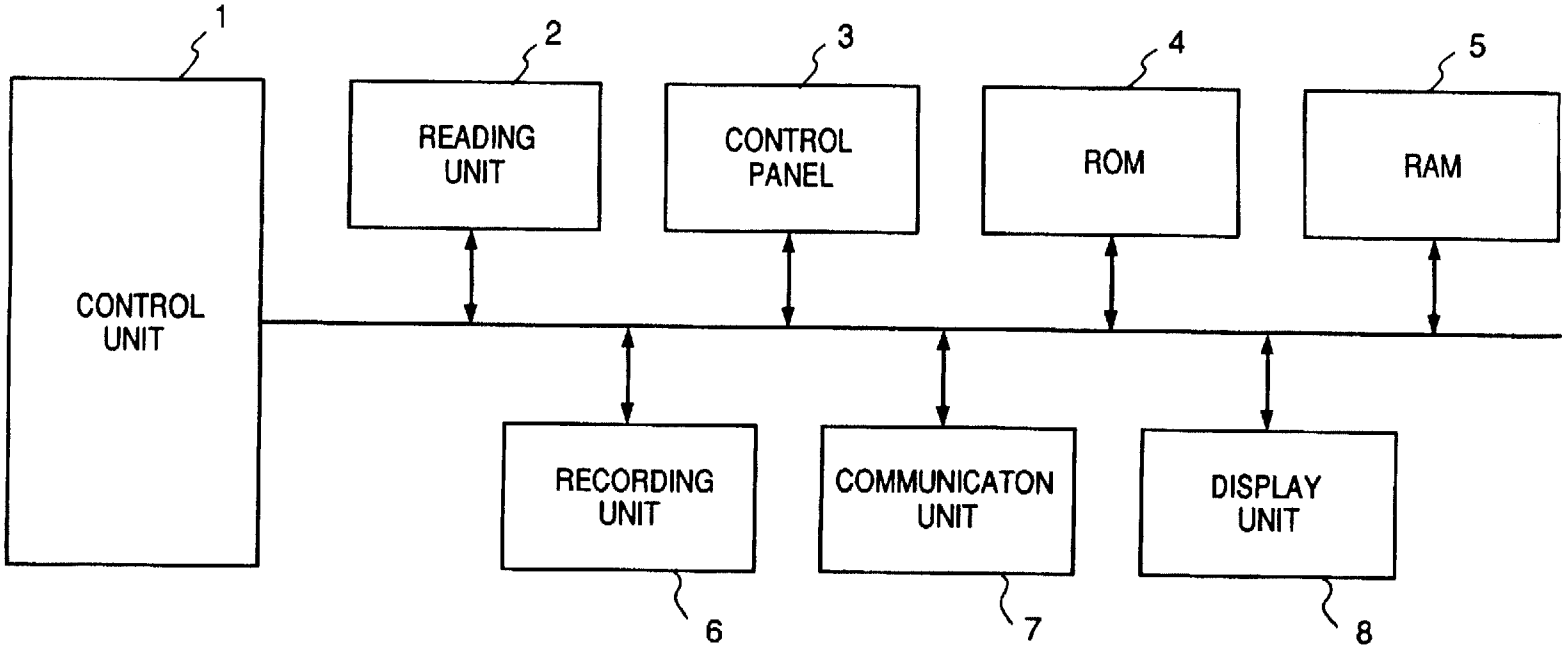
FIG. 1 is a block diagram illustrating a facsimile apparatus according to a first embodiment of the present invention.

FIG. 1 illustrates an example of the construction of a facsimile apparatus according to a first embodiment of the present invention.

<Construction of the apparatus>

A control unit 1 comprising a microprocessor or the like performs overall control of the apparatus in accordance with a program stored in a ROM 4. A RAM 5 is a memory for storing various constants entered by an operator using a control panel 3 as well as variables used when the control unit 1 executes various processing. The RAM 5 is read/written as needed. A display unit 8 displays messages for giving guidance during various operations such as registration, various warnings as well as the status of the apparatus, such as the present time. A reading unit 2 reads an original and a recording unit 6 prints out image signals as well as various reports such as apparatus constants. A communication unit 7 comprises an NCU (network control unit) and a modem, etc., and is connected to a communication network so as to send and receive communication data.

Figure 7:
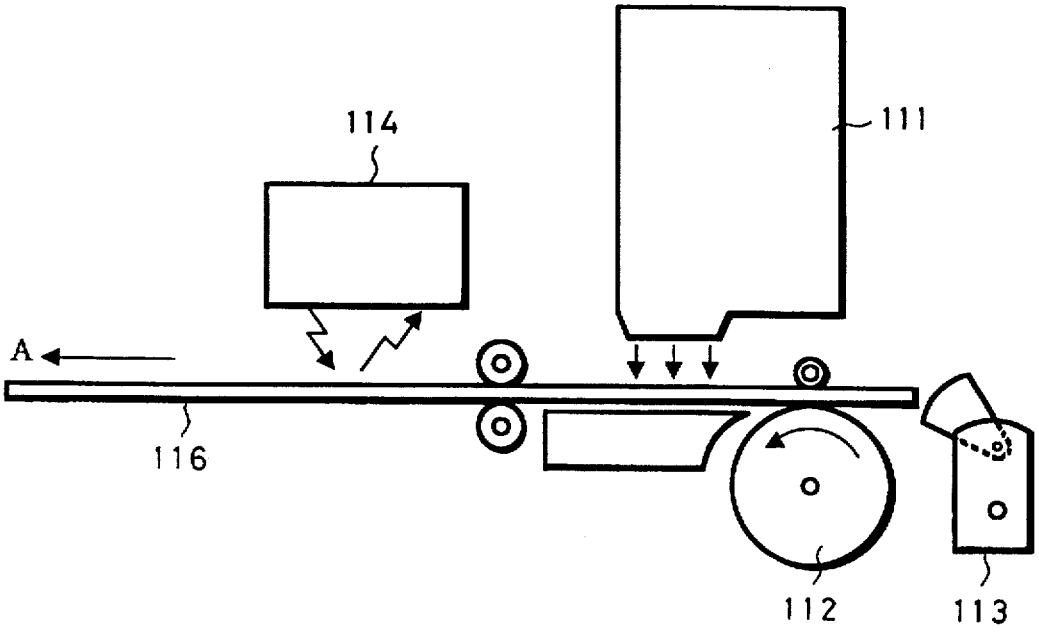
FIG. 7 is a diagram showing the construction of a recording unit in a facsimile apparatus according to the first embodiment.

The details of the recording unit 6 will now be described with reference to FIGS. 7 and 8, in which FIG. 7 is a diagram showing the construction of the recording unit according to this embodiment.

The recording unit includes an ink-jetting recording head 111 having nozzles for jetting ink droplets. The nozzles are arranged in one row of 64 dots in the sub-scan direction (the direction of arrow A) for printing at a density of 360 dpi. The recording head 111 records on recording paper at the recording density of 360 dpi while being moved in the main-scan direction (perpendicular to the plane of FIG. 7 and in the direction of arrow B in FIG. 8) by a carriage. In this embodiment, a change of state is produced in ink using thermal energy generated by an electrothermal transducer provided for each nozzle, whereby ink droplets are jetted from the nozzles to record an image. Thus, recording of an image is executed at a recording density of 360 dpi×360 dpi.

A recording paper conveyor 112 supplies recording paper, discharges the recording paper and conveys the recording paper at a precision of 360 dpi in order to decide position in the sub-scan direction when recording operation is performed by the recording head 111. A recording paper sensor 113 attains the ON state if recording paper 116 is present and an OFF state if the recording paper 116 is absent. Thus, the recording paper sensor 113 senses whether the recording paper 116 is present or not as well as the leading and trailing edges of the recording paper. A reflective-type photosensor 114 senses the image density of the recording surface of the recording paper 116. The photosensor 114 senses the image density of a footer mark recorded on the recording paper after one page of an image has been recorded, as described below, thereby detecting the absence or presence of ink and whether ink is failing to be jetted. The recording unit 111, recording paper conveyor 112 and recording paper sensor 113 are controlled in accordance with a control procedure from the control unit 1.

Figure 8:
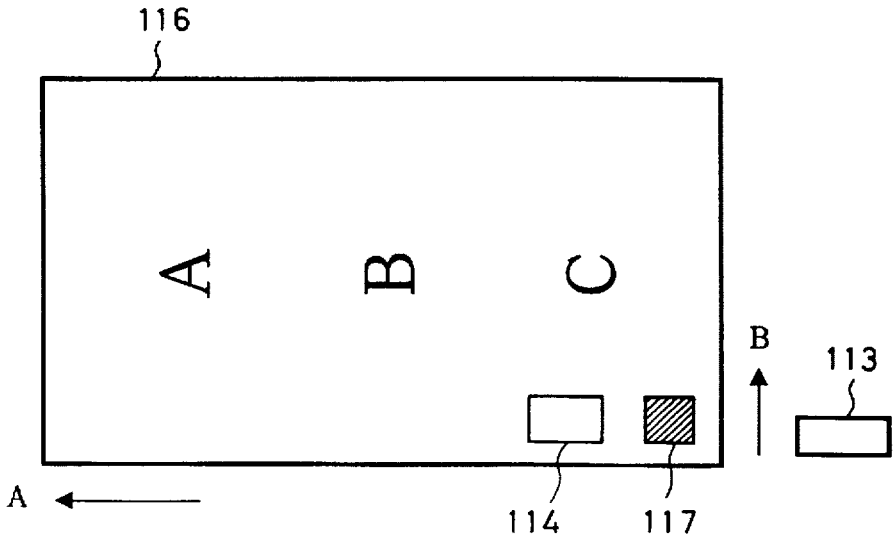
FIG. 8 is a diagram showing the positional relationship between a recording-paper sensor and a photosensor.

FIG. 8 illustrates the positional relationship between the recording paper sensor 113 and the photosensor 114. Numeral 117 denotes a footer mark recorded on the recording paper after one page of an image has been recorded, as well as the position at which the footer mark is recorded. The sensors 113, 114 and the mark 117 are arranged along a straight line in the conveyance direction (direction A) of the recording paper. These are situated along the leftmost edge of recording paper 116 within a range in which the recording unit 111 is capable of recording on the paper 116.

Figure 2:
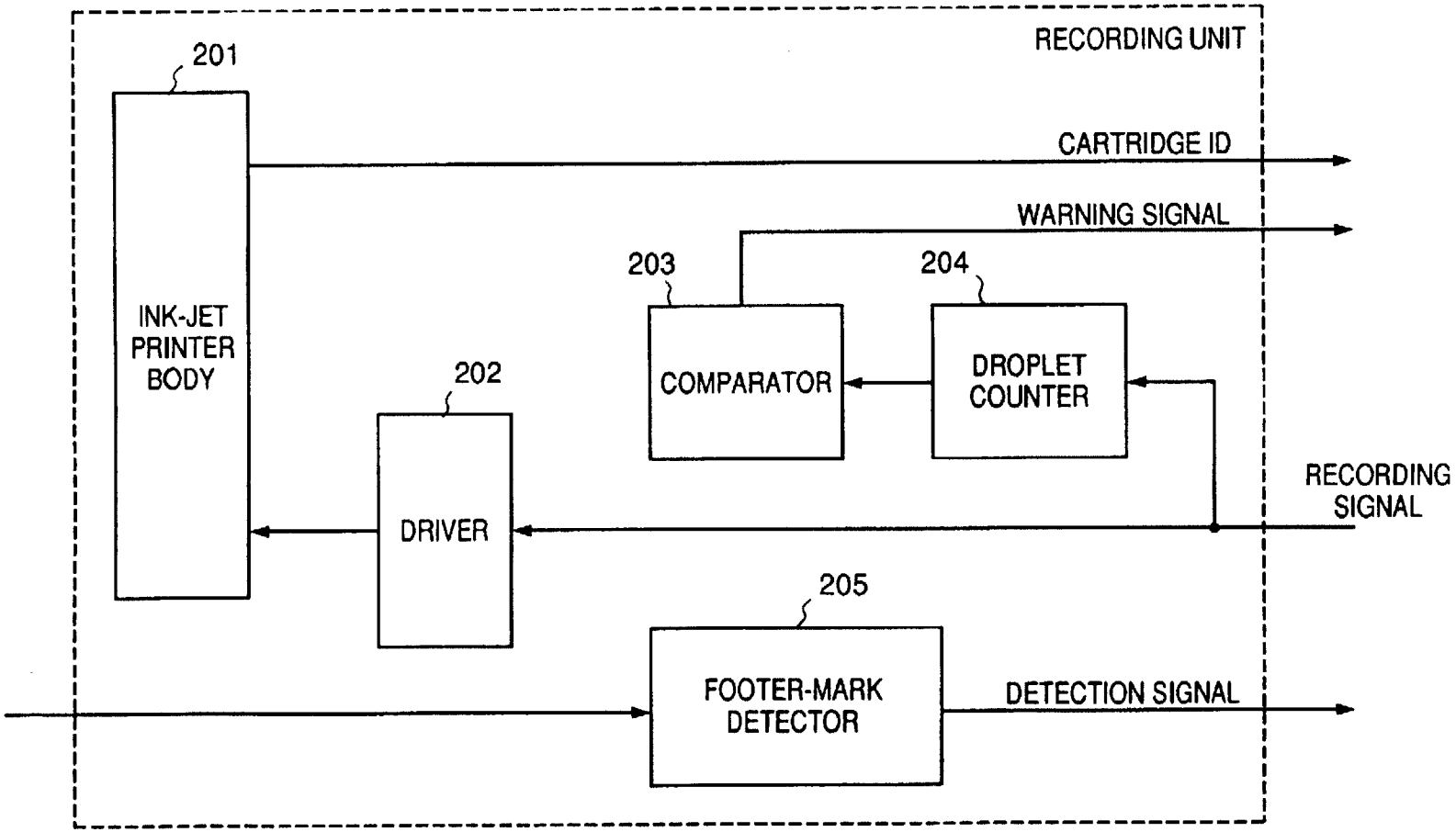
FIG. 2 is a block diagram illustrating a recording unit shown in FIG. 1.

FIG. 2 is a block diagram illustrating the recording unit 6 shown in FIG. 1.

The recording unit has a printer body 201 provided with the ink-jet head, the recording paper sensor and monitor means for monitoring the ID signal of an ink cartridge that has been loaded. In this embodiment, the ink-jet head is of the type which performs recording by jetting ink using thermal energy.

A driver 202 performs control for heat drive and motor drive of the ink-jet head. A counter 204 detects an image recording signal from the control unit 1 to count the number of ink droplets jetted. The counter 204 sends a comparator 203 a signal indicative of the counted value.

The capacity of the ink cartridge is stored in the comparator 203 beforehand as a count value of droplets corresponding to the cartridge capacity. The comparator 203 compares this count value with the count value that enters from the counter 204. When it is judged as a result of the comparison that only a slight amount of ink remains, the comparator 203 sends the control unit 1 a signal indicating that the ink has been depleted.

A footer-mark detector 205, which includes the photosensor 114, detects the absence or presence of the footer mark on recording paper (the footer mark will be detected on recording paper on which the mark has been recorded) and notifies the control unit 1.

In this embodiment, the recording method performed by the printer body 201 is to jet ink by heating an ink solution using electrothermal transducers. This method will now be described.

<Description of ink-jet recording method>

Figure 5:
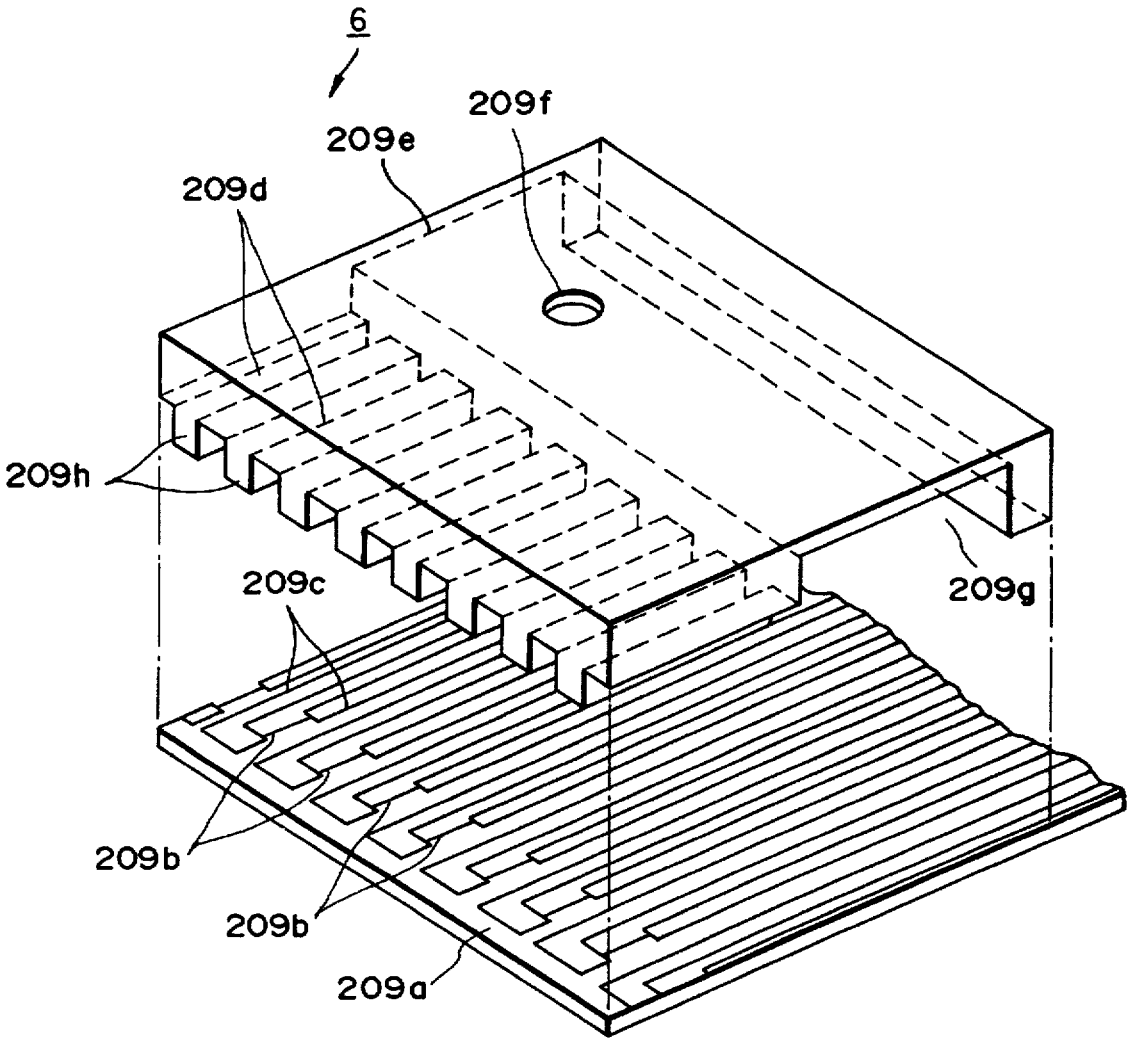
FIG. 5 is an exploded perspective view showing an ink-jet head according to the first embodiment.

FIG. 5 is an explanatory view and shows the ink-jet head, which constitutes the recording means, in exploded form. FIGS. 6A to 6G are views for describing the recording principle based upon use of this head. A typical arrangement and the related principles of operation are disclosed in the specifications of U.S. Pat. No. 4,723,129 and U.S. Pat. No. 4,740,796.

As shown in FIG. 5, the head includes a heater board 209*a*. The heater board 209*a* includes a silicon substrate, electrothermal transducers (jetting heaters) 209*b* and electrodes 209*c* such as of aluminum for supplying the heaters 209*b* with electric power. The transducers and electrodes are formed on the substrate as films. A plate 209*e* having partition walls for delimiting recording-liquid flow paths (nozzles) 209*d* is affixed to the heater board 209*a*. An ink cartridge for supplying the ink-jet head with ink is mounted at a prescribed location of the apparatus and is capable of being replaced.

Ink that has supplied by the ink cartridge via a conduit fills a common liquid chamber 209*g* inside the recording head 209 from a supply port 209*f* provided in the plate 209*e*, and the ink is led into each of the nozzles 209*d* from the chamber 209*g*. Each nozzle 209*d* is formed to have an ink jetting port 209*h*. The ink jetting ports 209*h* oppose the recording sheet of the recording head 209 and are formed at a prescribed spacing in the sheet conveyance direction.

In this embodiment, the recording head 209 having the above-described construction is mounted on a reciprocating carriage and performs recording by jetting ink in synchronism with movement of the carriage.

Figure 6A:
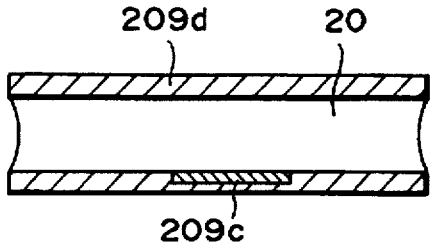
FIGS. 6A to 6G are series of diagrams for describing the manner in which ink is jetted by the ink-jet head according to the first embodiment.
Figure 6B:
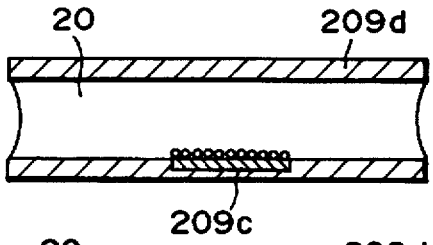
Figure 6C:
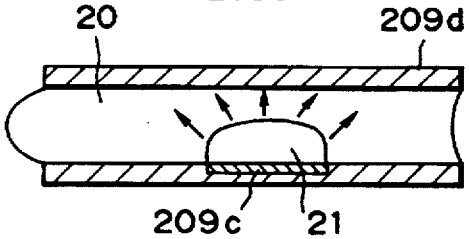

The ink-jetting principle used in the method of this embodiment will now be described with reference to FIGS. 6A through 6G. In the steady state, ink 20 filling the nozzle 209*d* exhibits equilibrium between surface tension and external pressure at the surface of the jetting port, as shown in FIG. 6A. If the ink 20 is to be jetted under these conditions, electric current is passed through the electrothermal transducer 209*b* inside the nozzle 209*d* to rapidly raise the temperature of the ink beyond the point of nucleate boiling. When this is done, the ink neighboring the electrothermal transducer 209*b* is heated so that minute bubbles are produced, as shown in FIG. 6B. The ink at the heated portion is vaporized to produce film boiling in such a manner that a bubble 21 grows rapidly in size, as depicted in FIG. 6C.

Figure 6D:
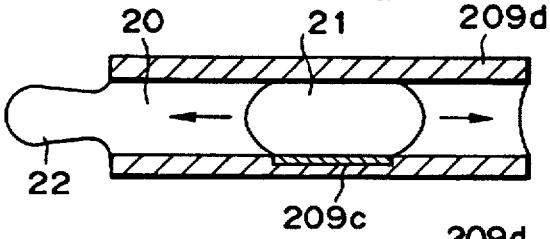
Figure 6E:
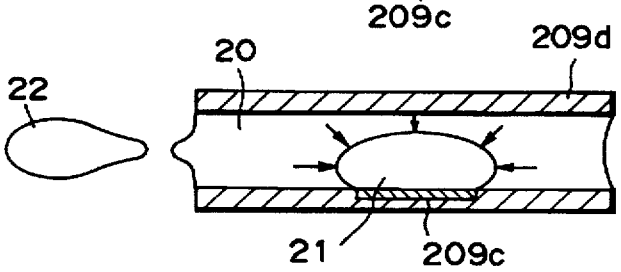
Figure 6F:
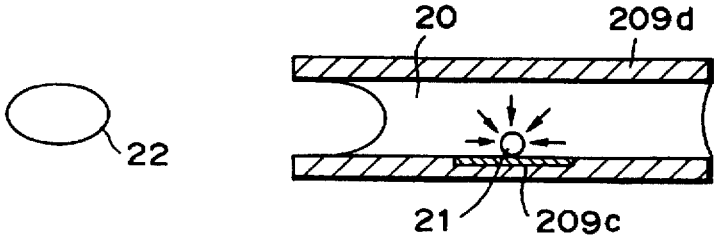
Figure 6G:
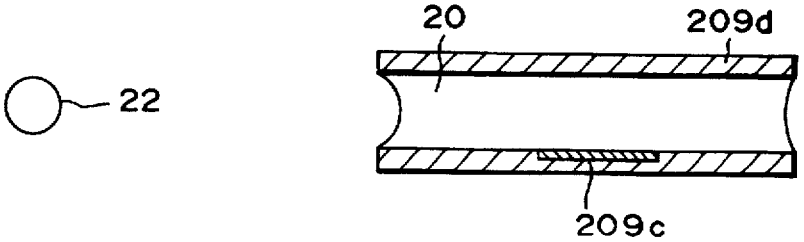

When the bubble 21 grows to its maximum size, an ink droplet 22 is thrust out from the jetting port of the nozzle 209*d*, as illustrated in FIG. 6D. When the flow of current through the electrothermal transducer 209*b* is halted, the enlarged bubble 21 contracts owing to cooling by the ink 22 inside the nozzle 209*d*. Owing to this growth and contraction of the bubble, the ink droplet is jetted from the jetting port, as shown in FIG. 6E. As the ink contacts the surface of the electrothermal transducer 209*b*, it is cooled rapidly so that the bubble 21 disappears or contracts to a volume which is almost negligible, as shown in FIG. 6F. When the bubble 21 thus contracts, the interior of the nozzle 209*d* is supplied with ink from the common liquid chamber 209*g* by capillary action, thereby preparing from the next passage of electric current.

Accordingly, an ink image is recorded on the recording sheet by reciprocating the carriage mounting the recording head and passing current through the electrothermal transducers 209*b* in synchronism with this movement and in accordance with the image signal. Alternatively, an image can be recorded using a line head as well.

Furthermore, besides the combination of the ink jetting ports, flow passageways and electrothermal transducers described above, arrangements disclosed in the specifications of U.S. Pat. No. 4,558,333 and Japanese Patent Application Laid-Open (KOKAI) No. 59-123670 can be adopted as the ink-jet head. In these disclosures a thermally active portion is disposed in a curved area.

Further, an arrangement may be adopted in which ink is supplied to the ink-jet head from the ink cartridge loaded in the printer body 201. In a case in which the head is internally provided with an ink accommodating chamber and the ink in the chamber is depleted, a replaceable head in which the ink-jet head can be replaced may be used.

Thus, ink droplets are formed in accordance with the image signal and the image is recorded on recording paper through the principle set forth above.

<Procedure of recording operation>

Figure 3:
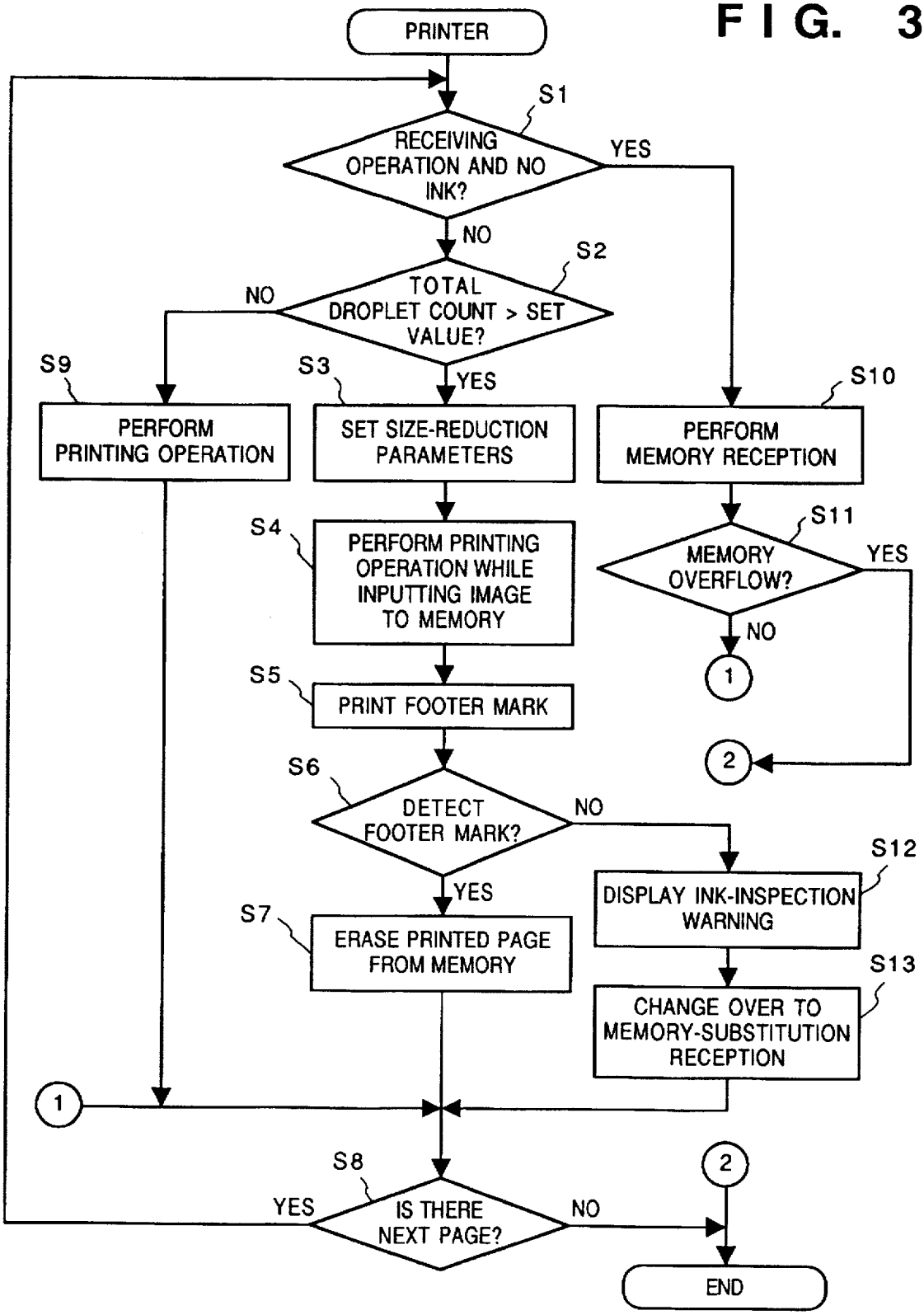
FIG. 3 is a flowchart representing the operation of the first embodiment.

The details of operation will now be described in accordance with the flowchart of FIG. 3. This flowchart represents the procedure of printing processing executed by the control unit 1 of FIG. 1. Operation branches to this print processing when the facsimile apparatus receives image data and prints out the data and when various reports are outputted.

First, in a case where image data is received, the control unit 1 performs a check at step S1 to determine whether ink has already run out before printout is performed.

If the apparatus has already run out of ink, printout is impossible and therefore the program proceeds to memory reception at step S10, where one page of data is received and stored in memory (the RAM 5). Next, at step S11, it is determined whether reception of one page of data in the memory has been performed normally. If reception has been performed normally, then the program branches to step S8, at which it is determined if there is a next page. This operation is repeated until the final page is reached ("NO" at step S8).

In a case where memory reception could not be performed normally, as when the memory is filled to capacity and can no longer store data ("YES" at step S11), error processing is executed and the apparatus returns to the standby state.

If it is found at step S1 that the ink has not been depleted, or in a case where the apparatus is performing an operation other than reception, the total droplet count value is checked at step S2.

If the total droplet count value is equal to or greater than a count value (a set value) corresponding to the volume of ink stored beforehand in the ROM 4 or RAM 5, then it is judged that there is very little ink remaining and processing is executed to detect the remaining amount of ink based upon the recording of the footer mark. The set value of the count corresponding to the volume of ink usually differs from one ink cartridge to another. Further, in this embodiment, the remaining amount of ink is checked, based upon the total droplet count value, solely at the head of a page. Accordingly, in order to take into account the above-mentioned variance in the set count corresponding to ink volume, the count value is set to the value which would prevail for the smallest case.

The total droplet count value is reset to zero when a new ink cartridge is loaded. Whether a new ink cartridge has been loaded is judged by reading the cartridge ID. If the cartridge loaded has the same ID as that read previously, then counting resumes without resetting of the count value.

If it is judged at step S2 that the remaining amount of ink is greater than a fixed amount, then processing is not executed to detect the remaining amount of ink based upon the recording of the footer mark. Instead, processing for recording the image real size is performed at step S9. The above-mentioned processing is repeated up to the final page while the check regarding whether or not there is a next page is performed at step S8.

At the time of printout, the total droplet count value is incremented for each image signal. As set forth earlier in the description of ink jetting, the number of droplets can be counted as the number of times voltage is applied to the recording head because the number of times voltage is impressed upon the electrothermal transducer of each nozzle in the head corresponds to the number of droplets jetted. In this case, the droplets counted are not only those needed to actually record an image but also those jetted from the nozzles in order to eliminate ink whose viscosity is too high. Further, in a case where the droplets correspond to black pixels of an image signal, the number of black pixels in the image signal can be counted as the number of droplets jetted.

If the check performed at step S2 indicates that the total droplet count value is greater than the set value, i.e., that there is very little ink remaining, then parameters are set at step S3 in order to perform recording of reduced size image in the main- and sub-scan directions.

Performing recording at reduced size is for the purpose of producing enough space to record a footer mark, described later, for a case in which paper has been cut to a standard size. The ratio of image reduction varies depending upon the size of the footer mark.

The printing operation is performed at step S4. Since there are instances where ink runs out in the course of the printing of one page, the data being outputted is stored in memory at the same time in a case where data that has been accumulated in the memory is not outputted. Alternatively, the printing operation may be started after the data is stored in memory beforehand.

Figure 4:
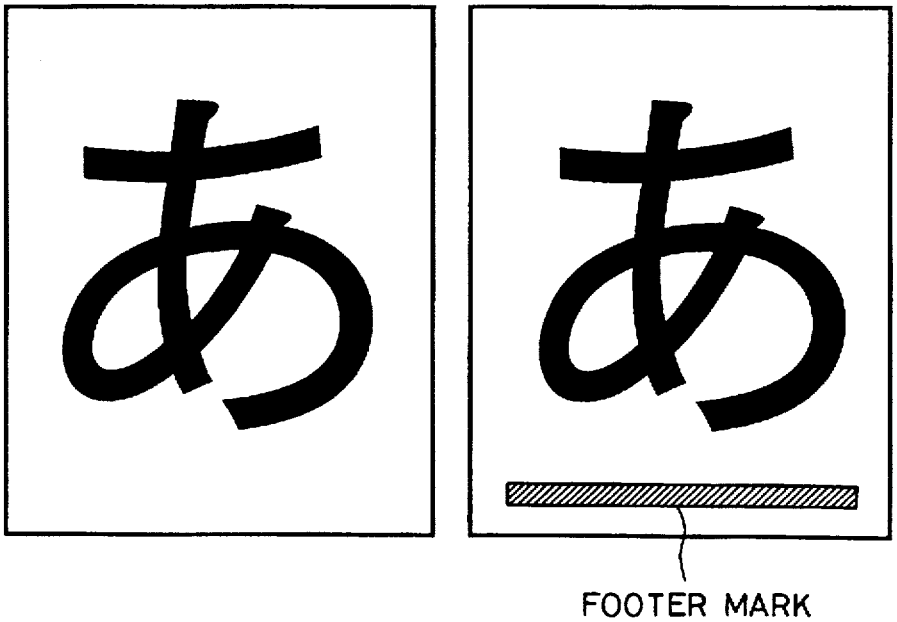

FIG. 4 is an example of reduced-size printout in comparison with a printout of real size.

When this printout is performed, the total droplet count value is incremented for each image signal in the same manner as the printout operation of real size.

At the end of printout of one page, a footer mark is printed at step S5. Since it will suffice if the control unit is capable recognizing the absence or presence of ink, the footer mark should be made as small as possible upon taking the image reduction ratio into consideration. However, owing to risk of erroneous recognition, the footer mark is set to a size commensurate with the capability of the detector 205.

The footer mark is detected at step S6. If the footer mark can be detected, this means that printout has been performed normally with regard to one page. Accordingly, one page of an image is erased from the memory at step S7. This is followed by step S8, at which it is determined whether there is a next page of data. If there is a next page, the processing from step S1 onward is executed again. If there is no next page, end processing is executed and the apparatus returns to the standby state.

If the footer marker cannot be detected at step S6, this means that the ink has run out in the course of printing one page. Accordingly, this page stored in the memory is not erased and a warning indication is presented at step S12. Then, from this point onward, a changeover is made at step S13 to memory reception, after which the check for the next page is performed at step S8.

As a result of the changeover at step S13, a "NO INK" decision is rendered at step S1 thereafter.

By checking the remaining amount of ink through the foregoing procedure, it is no longer necessary to print the footer mark on every page and it is possible to prevent a deterioration in image quality caused by the image size reduction for the purpose of detecting the remaining amount of ink. This also prevents wasteful consumption of ink.

In this embodiment, counting processing is executed with respect to each image signal using the amount of ink jetted for each image signal as a count of droplets and then performing detection of remaining amount of ink by means of the comparator 203. However, if an arrangement is adopted in which software is used to count the number of nozzles that jet ink in response to an output pattern whenever an image signal is outputted, the counter 204 of the recording unit 6 and the comparator 203 can be eliminated. This is advantageous in terms of lowering cost and conserving substrate mounting area.

Further, according to this embodiment, an image of reduced size is recorded in order to print and detect the footer mark. However, on the assumption that the leading edge of an image generally has header information added thereto at the time of image-data reception, it is possible to delete the leading-edge portion of the image and print the header mark in the trailing-edge portion where a blank space is produced as a result. Alternatively, the footer mark can be superimposed on part of the image data at the trailing edge. In either case, a deterioration in the image caused by size reduction can be eliminated.

In this embodiment, the ID of the ink cartridge is read automatically to determine whether the ink cartridge is new or one currently in use. However, if an arrangement is adopted in which the operator initializes the recording unit 6 when a new ink cartridge is loaded, the means for automatically reading the ID of the ink cartridge can be eliminated, thereby simplifying the construction of the ink cartridge and control unit. This is advantageous in terms of lowering cost and conserving substrate mounting area.

Thus, as described above, the facsimile apparatus according to this embodiment is characterized in that once an ink cartridge is replaced or ink replenished, the number of ink jetting operations conforming to an image is counted whenever an image is printed out, and the count value is compared with a preset count value corresponding to the original volume of the ink. Further, if there is some leeway in terms of the amount of ink left, printing is performed at the real size because detection of the amount of ink is not performed. If it is judged that the amount of ink left is very small, processing for detecting the remaining amount of ink based upon recording and detection of the footer mark is carried out. As a result, a state in which ink has run out can be sensed accurately and a deterioration in the image can be prevented to the maximum degree.

Since detection of ink depletion is performed in two stages, the operator can be notified of the prevailing status in two stages, namely by advance notice of ink depletion and then notification of the fact that printing has actually become impossible. This provides the operator with extra time for the purpose of preparing a replacement ink cartridge and assures that the apparatus will not be left without ink.

Further, even if it is determined that there is no ink in the ink cartridge, a determination is also made as to whether printing is possible in actuality. As a result, reception of data can continue, without loss of received data, until printing actually becomes impossible owing to depletion of ink. This allows the ink to be used efficiently.

The method of detecting remaining amount of ink in this embodiment involves counting the number of jetted ink droplets. This means that the limited volume of the ink tank or the limited space about the periphery of the recording head is not occupied by sensors and other peripheral devices. This allows available space to be utilized efficiently.

[Second Embodiment]

A second embodiment of the invention will now be described in detail with reference to the drawings.

<Construction of facsimile apparatus>

Figure 9:
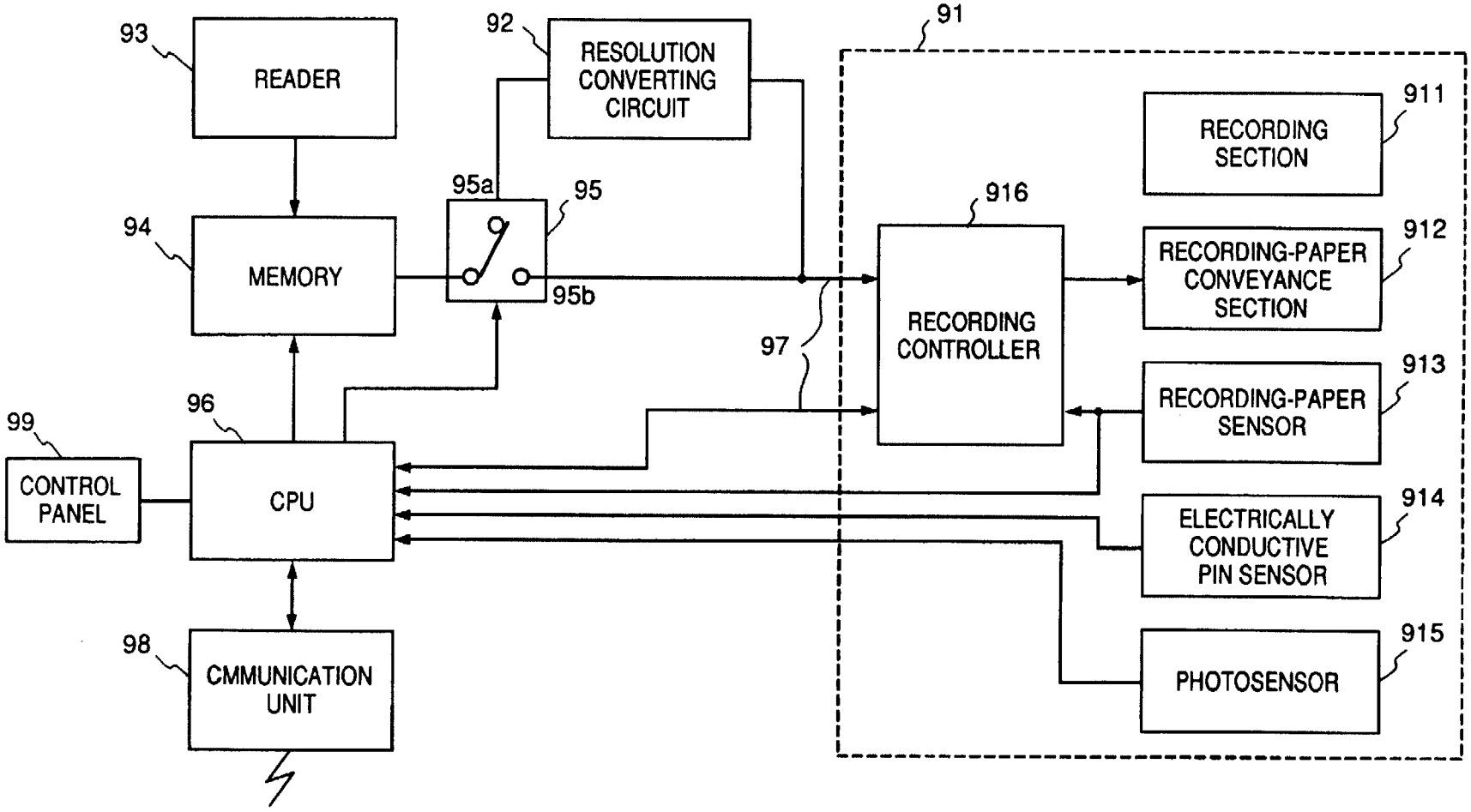
FIG. 9 is a block diagram illustrating the construction of a principal portion of a facsimile apparatus according to the second embodiment.

FIG. 9 is a block diagram showing the construction of a principal portion of a facsimile apparatus according to this embodiment. As shown in FIG. 9, an image printer 91 uses a head having a recording density of 360 dpi×360 dpi employed in recording an image on a recording medium such as recording paper. In this embodiment, ink is jetted from the head by causing a change in the state of the ink using thermal energy. The facsimile apparatus includes a resolution converting circuit 92 for converting a resolution of 8 pel×7.7 line/mm (hereinafter referred to as "resolution A") and a resolution of 8 pel×3.85 line/mm (hereinafter referred to as "resolution B") to a resolution of 360 dpi×360 dpi (hereinafter referred to as "resolution C"). A reader 93 reads an original at resolution A or resolution B. A memory 94, which has a capacity of 4 megabits, stores image information indicative of the original read by the reader 93, received image information and control data for controlling the image printer 91. A changeover unit 95 selects resolution is to be converted or not. Image data read out of the memory 94 has its resolution converted by the resolution converting circuit 92 when the changeover unit is switched over to the side of terminal 95*a*. No conversion is applied to this image data if the changeover unit is switched over to the side of terminal 95*b*. In such case the image data is sent directly to the image printer 91. A CPU 96 performs overall control of the apparatus. A control signal 97 allows the CPU 96 to control a recording controller 916. A communication unit 98 controls the connection to a telephone network and includes a MODEM, NCU, etc. A control panel 99 allows the operator to control the facsimile apparatus and is composed of input keys, an LCD panel for display purposes, etc.

<Construction of recording unit>

Figure 14:
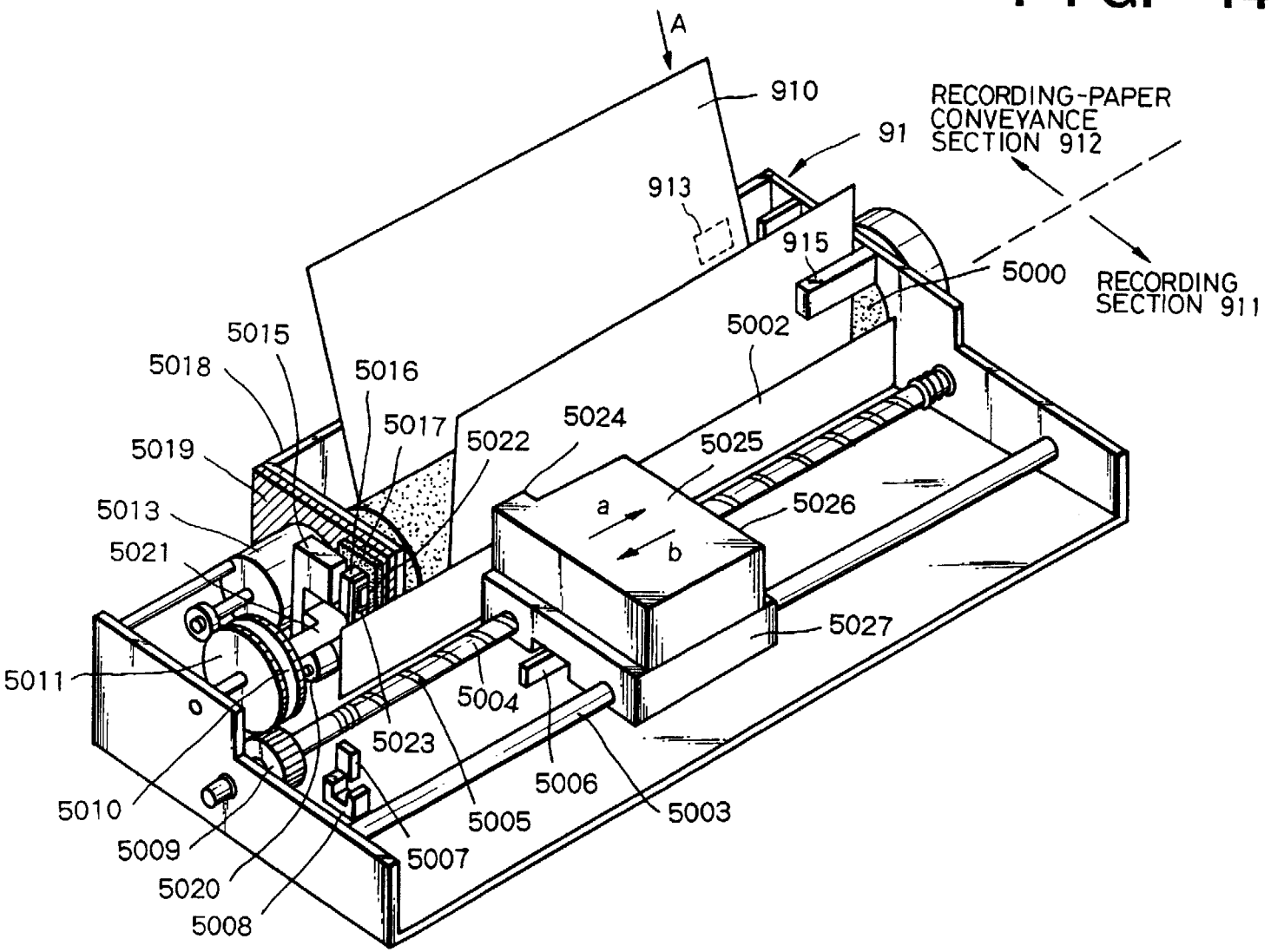
FIG. 14 is a diagram showing the structure of a recording unit of the ink-jet type.

The construction of the image printer 91 will be described in further detail. First, however, reference is made to FIG. 14 showing an external view of the structure of the image printer. As shown in FIG. 14, the image printer 91 comprises a recording-paper conveyance section 912 and a recording section 911. The recording section 911 includes a lead screw 5005 operated via driving-force transmission gears 5011, 5009 in operative association with forward and reverse rotation of a drive motor 5013. The lead screw 5005 is provided with a helical groove 5004 mating with a pin (not shown) on a carriage 5027. The carriage 5027 is reciprocated in directions of arrows a and b as the lead screw 5005 rotates. An ink-jet cartridge 5026 is mounted on the carriage 5027 and includes an ink tank 5025 and a recording head 5024. As the carriage 5027 is reciprocated, ink is jetted from the head 5024 to record an image. An ink tank 5025 is equipped with a conductive-pin sensor 914 for sensing the remaining amount of ink, though this is not shown in this drawing. The recording section 911 includes the carriage 5027, the cartridge 5026, the ink tank 5025 and the recording head 5024.

The recording-paper conveyance section 912 includes a paper pressing plate 5002 for pressing recording paper 910 against a platen 5000 along the traveling direction of the carriage. Photocouplers 5007, 5008 verify the presence of a carriage lever 5006 in this area so as to sense a home position for the purpose of changing over the direction of rotation of the motor 5013. A support member 5016 supports a cap 5022 which caps the front side of the recording head 5024. A suction unit 5015 produces suction inside the cap to attract and restore the head 5024 via an opening 5023 inside the cap. A cleaning blade 5017, which is for wiping off the jetting ports of the recording head 5024, is supported by a member 5019 on a supporting plate 5018 so as to be movable back and forth. It goes without saying that the cleaning blade 5017 need not have this form; a well-known cleaning blade can also be applied to this example. Further, a lever 5021 is for starting recovery by suction. The lever 5021 moves with motion of a cam 5020 engaged by the carriage 5027. Movement is controlled by well-known transmission means such as a clutch changeover device applied to driving force from the driving motor.

The arrangement is such that the capping, cleaning and suction recovery are performed by execution of the desired processing at the respective corresponding positions by the action of the lead screw 5005 when the carriage has arrived in an area on the side of the home position. If it is so arranged that the desired operations are performed at a well-known timing, these can be applied to this example.

Further, the recording-paper sensor 913, which senses whether the recording paper 910 is present or not, is attached near the entrance to the recording paper conveyance section 912 where the recording paper enters. A photosensor 915 senses the mark printed on the edge of the recording paper 910 by the head 5024. Though not shown, the photosensor is actually secured to the chassis of the apparatus.

<Construction for detecting remaining amount of ink>

Figure 10:
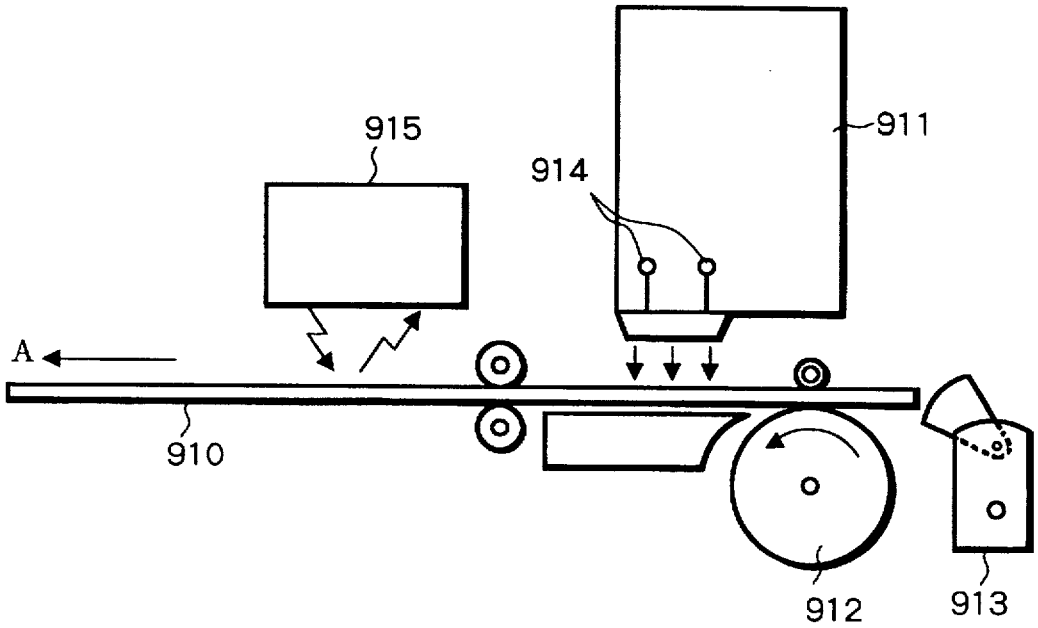
FIG. 10 is a diagram showing the arrangement of a recording unit according to a second embodiment of the present invention.

The image printer 91 is constructed as set forth above. Described next will be an arrangement for detecting remaining amount of ink. Reference will be had to FIG. 10, which is a schematic view of the ink-jet recording section.

As shown in FIG. 10, the recording section 911 includes a head having nozzles arranged in one row of 64 dots in the sub-scan direction (the direction of arrow A) for printing at a density of 360 dpi. The recording head 111 records on recording paper at the recording density of 360 dpi×360 dpi while being moved in the main-scan direction (perpendicular to the plane of FIG. 10 and in the direction of arrow B in FIG. 11). The recording-paper conveyance section 912 supplies and discharges recording paper and has a feed precision of 360-dpi steps in order to determine position in the sub-scan direction when recording is performed by the recording section 911. The recording-paper sensor 913 attains the ON state if recording paper is present and the OFF state in the absence of recording paper. Thus, the sensor 913 senses the absence/presence of the recording paper, its leading edge and its trailing edge. The electrode sensor 914 has electrically conductive pins recessed within an ink cartridge. The absence or presence of ink is sensed based upon the state of conduction between the pins. The photosensor 915 senses a value conforming to the percentage of a portion occupied by ink forming a prescribed image recorded on the recording surface of the recording paper. The photosensor 915 senses the recording paper owing to light reflected by the paper. The recording controller 916 converts the image data from the CPU 96 so that it can be recorded by the recording section 911 and controls the recording section 911, the recording-paper conveyance section 912 and the recording-paper sensor 913 in accordance with instructions in the control data sent from the CPU 96. Numeral 910 denotes cut paper on which an image is recorded.

By virtue of this arrangement, the amount of ink remaining in the ink tank is detected and a prescribed image recorded on the recording paper is optically detected so that it can be determined whether recording took place normally or not.

<Principle of resolution conversion>

The principle of resolution conversion will be described next.

In a facsimile apparatus in which reading and recording resolution differ and recording is performed at a recording density that differs from the resolution of the image communicated in facsimile transmission, a resolution converting circuit is required since it is necessary to perform recording at the same magnification (1×) as the original at the time of reception and copying. For example, in a case where image data read at a resolution of 8 pel×7.7 line/mm is recorded by a head having a resolution of 360 dpi×360 dpi, the image is recorded at the following reduction ratio if one pixel of recording is recorded to correspond to one read pixel:

main-scan direction: 8 pel/360 dpi=0.564 sub-scan direction: 7.7 line/mm/360 dpi=0.543

Accordingly, when nine bits of the original data are expanded into 16 bits in the main-scan direction and six bits are expanded into 11 bits in the sub-scan direction, we have main-scan direction . . . 0.564×(16/9)=1.003 sub-scan direction . . . 0.543×(11/6)=0.996

Thus, recording can be performed substantially at 1× magnification.

Figure 13A:
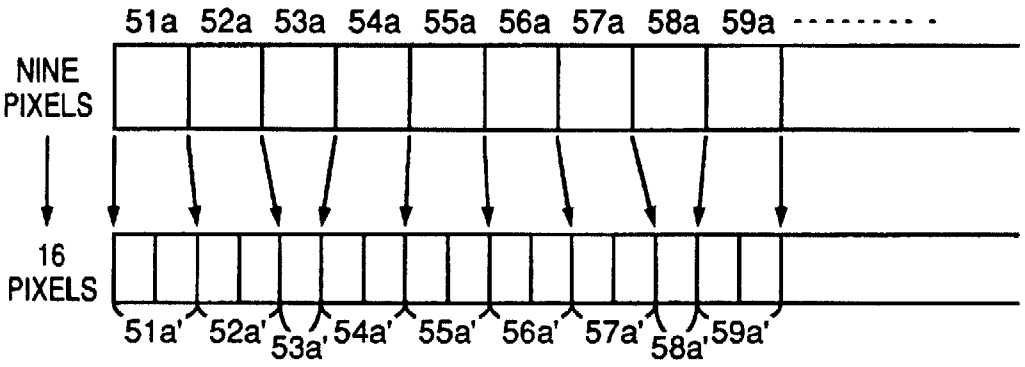
FIGS. 13A and 13B are conceptual views showing conversion of resolution in main- and sub-scan directions.
Figure 13B:
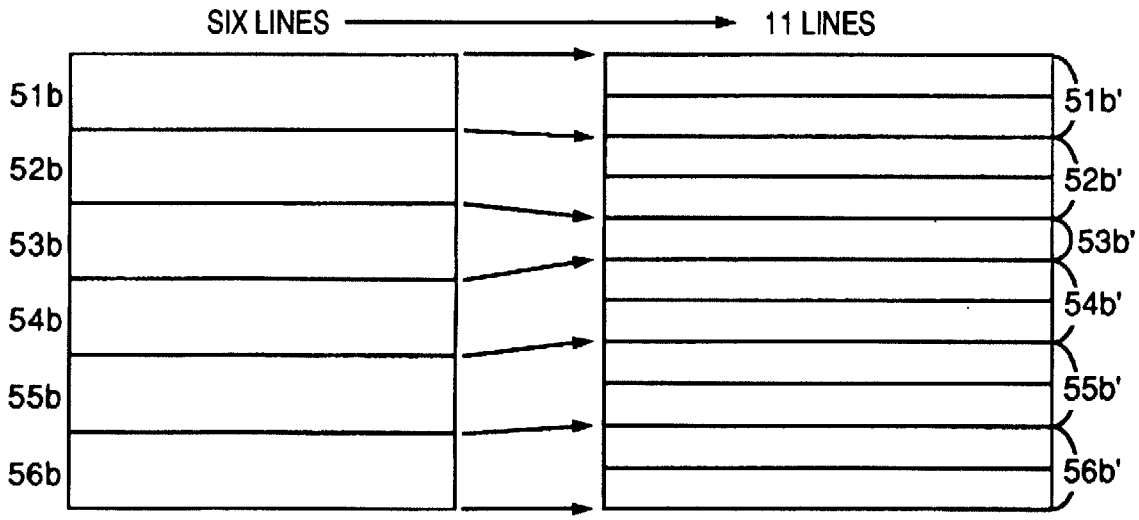

FIGS. 13A and 13B are diagrams showing, in simplified form, the concept of resolution conversion when copying a read image and when recording a received image. FIG. 13A illustrates resolution conversion in the main-scan direction. Here a read pixel 51*a* is replaced by two recording pixels 51*a*', a read pixel 53*a* is replaced by one recording pixel 53*a*', and so on. This makes it possible to perform recording at the magnification 1× in the main-scan direction. FIG. 13B illustrates resolution conversion in the sub-scan direction. Here one line 51*b* of read pixels is replaced by two lines 51*b*' of recording pixels, one line 53*b* of read pixels is replaced by one line 53*b*, of recording pixels, and so on. This makes it possible to perform recording at the magnification 1× in the sub-scan direction. The resolution converting circuit 92 uses a simple latch circuit for the main-scan direction. With regard to the sub-scan direction, the resolution converting circuit 92 writes the same line twice under the control of software.

Image data received by the communication unit 98, image data read by the reader 93, any image data created by the CPU 96 and control data with regard to the recording controller 916 are stored in the memory 94. Accordingly, in facsimile reception, the CPU 96 exercises control in such a manner that received image data sent at a resolution of 8 pel×3.85 line/mm or 8 pel×7.7 line/mm and stored in the memory 94 is subjected to a resolution conversion by the resolution converting circuit 92 by changing over the changeover circuit 95 to the side of terminal 95*a*, with the resulting image being recording at a magnification which is 1× that of the transmitted original.

Image data read by the reader 93 also is subjected to the same resolution converting processing, whereby copying at a magnification of 1× is performed.

When the changeover circuit 95 is changed over to the side of terminal 95*b*, the image data in memory 94 is not subjected to a resolution conversion but can be recorded by the image printer 91 with 1:1 correspondence between one pixel of image data and one pixel of recording. The changeover circuit 95 is changed over to the side of terminal 95*b* when control data is sent to the recording controller 916.

Figure 11:
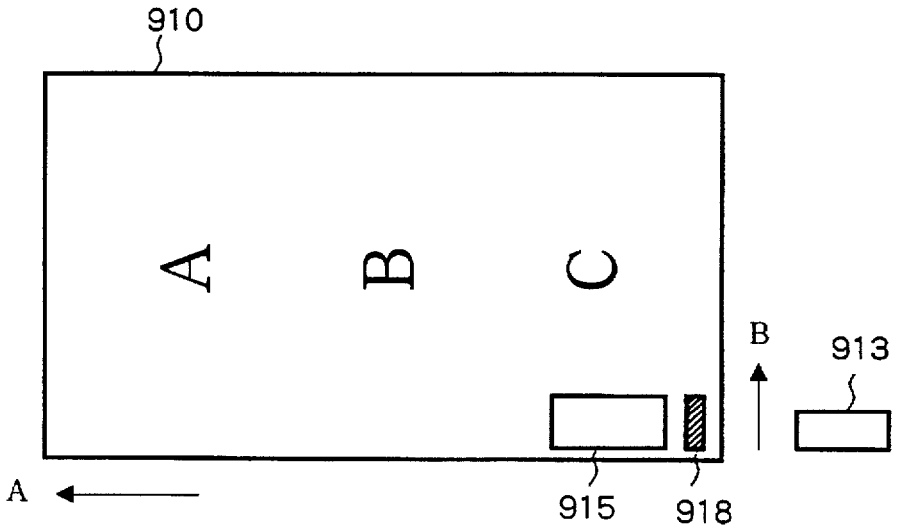
FIG. 11 is a diagram showing the positional relationship among a recording sensor, a photosensor and a position at which a footer mark is recorded.

FIG. 11 is a diagram showing the positional relationship between the recording-paper sensor 913 and the photosensor 915. The drawing shows the positional relationship as seen from the top.

In FIG. 11, a mark 918 is a prescribed image (referred to as a footer mark) recorded on the recording medium 910 at a prescribed position on the basis of prescribed image data. The recording-paper sensor 913, photosensor 915 and footer mark 918 are arranged along a straight line in the conveyance direction (direction A) of the recording paper. These are situated along the leftmost edge of the recording paper 116 within a range in which the recording unit 111 is capable of recording on the paper 116. Further, the footer mark 918 is recorded at a position which will leave a blank space of a prescribed length at the trailing edge of the recording paper 910. By adopting this arrangement, the photosensor 915 is capable of sensing the printed footer mark 918 and testing whether it has the printed shape intended, thereby making it possible to determine whether printing has been performed correctly.

<Printing control of facsimile image>

Control when an image obtained by facsimile reception is recorded will now be described.

Figure 12:
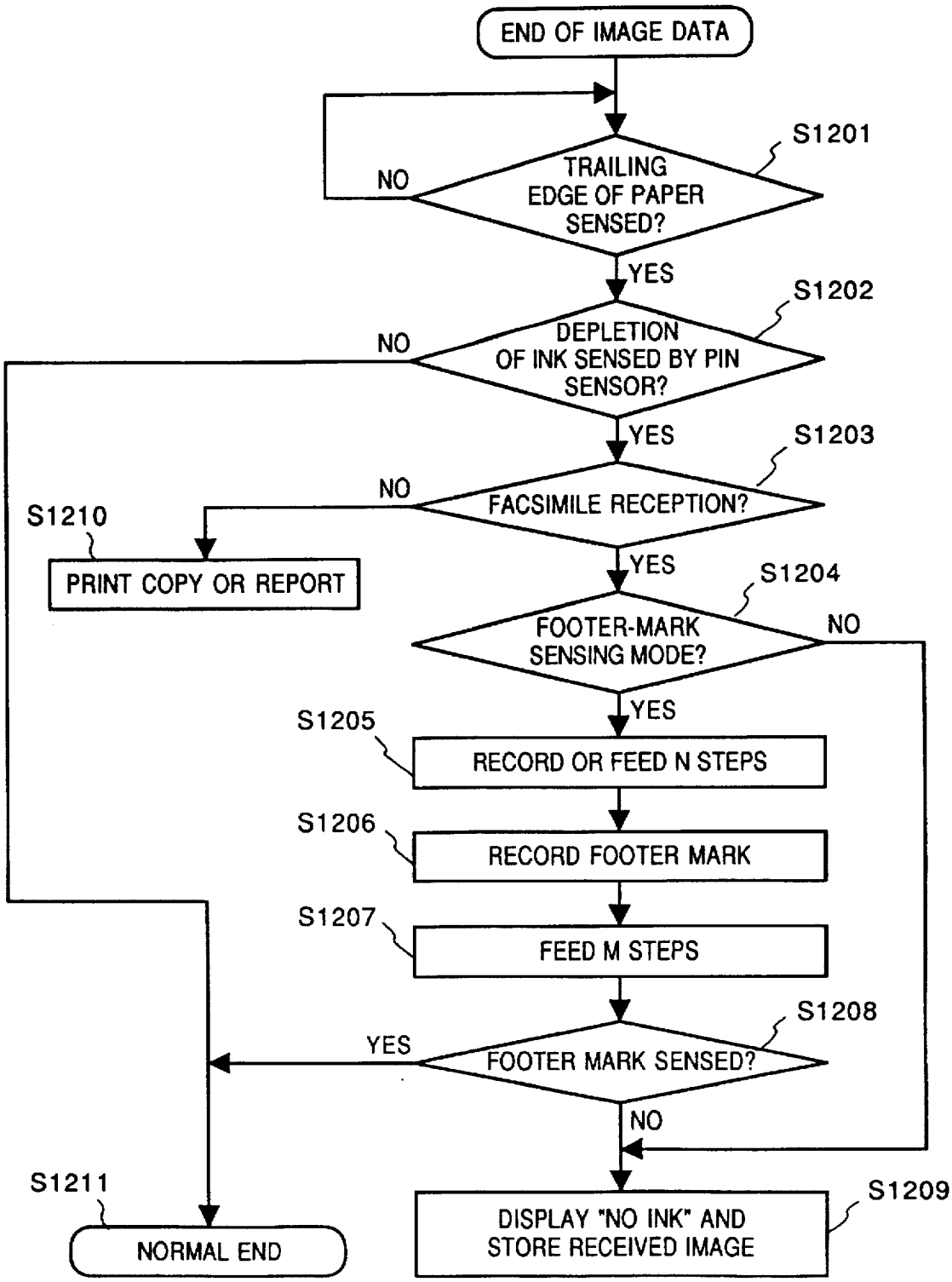
FIG. 12 is a flowchart representing the operation of the second embodiment.

When the leading edge of the recording paper 910 arrives at the recording-paper sensor 913, the sensor 913 attains the ON state. From this point onward the recording paper 910 is conveyed a prescribed length by the recording-paper conveyance section 912, whereby the paper is conveyed to the recording position of the recording section 911. Now the recording controller 916 controls the recording section 911 and the recording-paper conveyance section 912, whereby one page of image data whose resolution has been converted by the resolution converting circuit 92 is recorded on the recording paper 910. Subsequent control will be described with reference to the flowchart of FIG. 12. In this embodiment, the storage of received image data in the memory 94 and the recording of the data are performed concurrently. Furthermore, the flowchart of FIG. 12 is a procedure executed by the CPU 96, and it is assumed that data to be printed has been stored in the memory 94.

First, while recording operation is being performed on the recording paper 910, it is determined at step S1201 whether the recording-paper sensor 913 has attained the OFF state. If the answer is "YES" (i.e., if the trailing edge of the recording paper 910 is sensed), then the program proceeds to step S1202, at which the electrically conductive pin sensor 914 senses whether there is any ink. This is carried out as follows: A pair of electrodes for sensing amount of remaining ink are passed through an absorbing body consisting of an ink-permeated porous material in the ink tank within the main body of the ink-jet recording head, a current is passed through the electrodes and the amount of ink remaining in the ink tank is sensed based upon the resistance value between the electrodes. When ink is sensed, processing is terminated normally. When no ink is sensed, the program proceeds to step S1203. Here the CPU 96 determines whether the prevailing mode is for facsimile reception, for copying or for printout of a report such as a communication management report. When a copy is to be made or a report such as the communication management report is to be recorded, the printout is made at step S1210 without sensing whether there is ink or not based upon the footer mark. The reason for this is that the printout of a copy or report is performed by the user deliberately on the spot. Therefore, any abnormality in recording can be detected by the user at once and it is unnecessary for the facsimile apparatus to make a judgment concerning abnormality automatically.

When facsimile reception is in effect, the program proceeds to step S1204, at which a test is made to determine whether the apparatus has been set to the footer-mark sensing mode for sensing remaining amount of ink based upon the footer mark. If the prevailing mode is not the footer-mark sensing mode, then the CPU 96 holds the received image of the currently printing page stored in the memory 94 and notifies the user by a "NO INK" display of the fact that recording is abnormal.

If, on the other hand, the prevailing mode is the footer-mark sensing mode, the program proceeds to step S1205. Here the recording paper 910 is conveyed by the recording-paper conveyance section 912 until the position at which the footer mark 918 is to be recorded arrives at the recording position of the recording section 911 (the position of the head). In FIG. 12, the number of conveyance steps is made N steps (the number of steps obtained by dividing traveling distance by 1/360 inch).

Next, the footer mark is recorded on the recording paper 910 by the recording unit 911 at step S1206. The footer mark is an image obtained by storing image data created by the CPU 96 in the memory 94 and then sending the image data to the recording controller 916 via the terminal 95*a* of the changeover circuit 95. Here the footer mark is an all-black square each of whose sides has a length of about 4.5 mm, which corresponds to a recording width of 64 dots in the recording section 911.

This is followed by step S1207, at which the recording paper 910 is conveyed by the recording-paper conveyance section 912 in such a manner that the recorded footer mark 918 is moved to the sensing position of the photosensor 915. Here the number of conveyance steps is made M steps.

The density of the footer mark 918 is detected using the photosensor 915 at step S1208. If the footer mark 918 has been recorded at the prescribed recording position, there is a decrease in reflected light owing to the mark. If the percentage of ink adhesion at the position where the footer mark is to be recorded is sensed to have a value greater than a predetermined value, then it is judged that the footer mark 918 has been sensed and a decision is rendered to the effect that recording took place normally. If the recording section 911 runs out of ink and recording is not being performed normally, or if recording has been achieved but the amount of adhering ink is small, there will be a large increase in the light reflected from the position on the recording paper at which the footer mark should have been recorded. As a result, the photosensor 915 senses that the percentage of adhering ink at the footer-mark recording position 918 exhibits a value less than the predetermined value. When the photosensor 915 thus senses that the footer mark has not been recorded, the CPU 96 judges that recording is abnormal. In this case the CPU 96 holds the received image of the currently printing page stored in the memory 94 and notifies the user by a "NO INK" display of the fact that recording is abnormal.

By observing the "NO INK" display presented at step S1209, the operator becomes aware of the fact that the ink has run out and takes measures such as replacing the cartridge 5026 containing the ink tank 5025. After the cartridge 5026 is replaced, the facsimile apparatus follows the prescribed procedure to again record the image data for which the abnormality was detected during printing. Recording can thus be completed with certainty.

An arrangement may be adopted in which when the footer-mark sensing mode has not been set or the footer mark has not been recorded normally, the apparatus makes a transition to the substitute reception mode in which image data currently being printed, which data has been stored in the memory 94, as well as image data sent in from this point onward is stored in the memory 94, after which the image data thus saved may be recorded by a prescribed operation after the cartridge has been replaced.

Thus, as set forth above, joint use is made of an electrically conductive pin sensor for directly sensing that ink remains and a photosensor for sensing a footer mark recorded on recording paper at a prescribed position thereof. With such an arrangement it suffices to sense the remaining amount of ink based upon the footer mark only when the amount of remaining ink has become very small. This means that it is ordinarily unnecessary to reduce the size of the image in order to record the footer mark. In addition, the amount of ink expended can be reduced by the amount that would otherwise be used to record the footer marks. Furthermore, since reliance is not placed solely upon direct detection of remaining amount of ink, there is no danger that depletion of ink will go undetected or that depletion will be judged erroneously when some ink still remains.

In this embodiment, electrically conductive pins are used to detect if there is ink remaining in the ink tank. As a result, processing is simplified in comparison with the method of the first embodiment. In addition, there is smaller error in detection resulting from cumulative error, as in the case of counting droplets. Furthermore, the amount of ink remaining when ink depletion is detected can be changed in a simple manner merely by adjusting sensor position.

It should be noted that the sensor used to sense ink remaining in the ink tank is not limited to the electrically conductive pins mentioned in this embodiment. For example, sensing means may be employed in which ink is sensed directly by a reflective-type photosensor within the ink tank or in the ink passageway from the ink tank to the recording head, thereby making it possible to judge whether ink is present or not. Further, a method may be employed in which ink in the ink tank is sensed by measuring the weight of the ink tank.

Further, if a "YES" answer is obtained at step S1208, a normal end to processing is executed. However, another method which may be adopted is to cause the display unit to display the fact that the amount of remaining ink is small (such as by prompting the user to replace the cartridge).

In both the first and second embodiments, ink remaining in the ink tank is detected and a check is made to determine, in dependence upon the result of detection, whether the apparatus is in a state in which recording is actually possible. This allows the operator to ascertain whether printing is impossible because the ink has run out. It should be noted that the elements of the first embodiment and the elements of the second embodiment can be combined to construct a novel apparatus.

It would be desirable if some printing were possible in a state in which depletion of the ink has been sensed by the sensor. To this end, it would be desirable to set a sensor in such a manner that enough ink is left for some printing even if depletion of ink has been detected as a result of detecting whether ink is left in the ink tank. (This corresponds to remaining-ink detection by counting ink droplets in the first embodiment and to remaining-ink detection by the electrically conductive pins in the second embodiment).

Thus, as described above, the image recording apparatus and method and the facsimile apparatus according to the present invention detect a state of ink depletion highly accurately and prevent a deterioration in image quality caused by detection of remaining amount of ink. Furthermore, ink is not wasted for the purpose of detection remaining amount of ink.

The present invention is not limited to the above embodiments and various changes and modifications can be made within the spirit and scope of the present invention. Therefore, to apprise the public of the scope of the present invention, the following claims are made.

What is claimed is:

1. An image recording apparatus comprising:

reservoir means for storing ink;

recording means for recording an image on a recording medium by jetting droplets of ink supplied from said reservoir means;

first sensing means for sensing a remaining amount of ink stored in said reservoir means without jetting the ink droplets;

second sensing means for sensing the remaining amount of ink stored in said reservoir means by determining a condition of the image recorded by said recording means, thereby obtaining a sensing result;

control means for controlling said second sensing means to sense the remaining amount of ink stored in said reservoir means after said first sensing means senses that the remaining amount of ink stored in said reservoir means is a predetermined amount; and output means for outputting information conforming to the sensing result obtained by said second sensing means, wherein said control means does not activate said second sensing means until said first sensing means senses that the remaining amount of ink stored in said reservoir means is the predetermined amount.

2. The apparatus according to claim 1, wherein said second sensing means includes:

means for causing a prescribed pattern image to be recorded on the recording medium by said recording means;

a sensor for sensing a recorded density of the prescribed pattern image; and discriminating means for discriminating the remaining amount of ink based upon the recorded density sensed by said sensor.

3. The apparatus according to claim 2, wherein said first sensing means includes:

a pair of electrodes provided inside said reservoir means; and discriminating means for discriminating the remaining amount of ink in accordance with a state of conduction between said electrodes.

4. The apparatus according to claim 3, wherein said recording means includes a recording head having:

an energy generating element for generating energy to jet ink droplets; and a jetting port for jetting the ink droplets.

5. The apparatus according to claim 4, wherein said energy generating element generates thermal energy causing a chance of state of the ink, so that ink droplets are jetted from said jetting port.

6. The apparatus according to claim 2, wherein the image is recorded on the recording medium in pages, each page having a trailing edge portion, and after one page of the image has been recorded, said recording means records the prescribed pattern image on the trailing edge portion of the recording medium on which said one page of the image has been recorded.

7. The apparatus according to claim 6, wherein said recording means includes a recording head having:

an energy generating element for generating energy to jet ink droplets; and a jetting port for jetting the ink droplets.

8. The apparatus according to claim 7, wherein said energy generating element generates thermal energy causing a change of state of the ink, so that ink droplets are jetted from said letting port.

9. The apparatus according to claim 2, wherein said recording means includes a recording head having:

an energy generating element for generating energy to jet ink droplets; and a jetting port for jetting the ink droplets.

10. The apparatus according to claim 9, wherein said energy generating element generates thermal energy causing a change of state of the ink, so that ink droplets are jetted from said letting port.

11. The apparatus according to claim 1, wherein said first sensing means includes:

a pair of electrodes provided inside said reservoir means; and discriminating means for discriminating the remaining amount of ink in accordance a with state of conduction between said electrodes.

12. The apparatus according to claim 11, wherein said recording means includes a recording head having:

an energy generating element for generating energy to jet ink droplets; and a jetting port for jetting the ink droplets.

13. The apparatus according to claim 12, wherein said energy generating element generates thermal energy causing a change of state of the ink, so that ink droplets are jetted from said jetting port.

14. The apparatus according to claim 1, wherein said recording means includes a recording head having:

an energy generating element for generating energy to jet ink droplets; and a jetting port for jetting the ink droplets.

15. The apparatus according to claim 14, wherein said energy generating element generates thermal energy causing a change of state of the ink, so that ink droplets are jetted from said jetting port.

16. An image recording apparatus comprising:

reservoir means for storing ink;

recording means for recording an image on a recording medium by letting droplets of ink supplied from said reservoir means;

first sensing means for sensing a remaining amount of ink stored in said reservoir means, said first sensing means including counting means for counting an amount of ink used by said recording means and discriminating means for discriminating the remaining amount of ink based upon the amount counted by said counting means;

second sensing means for sensing the remaining amount of ink stored in said reservoir means by determining a condition of the image recorded by said recording means, thereby obtaining a sensing result;

control means for controlling said second sensing means to sense the remaining amount of ink stored in said reservoir means after said first sensing means senses that the remaining amount of ink stored in said reservoir means is a predetermined amount; and output means for outputting information conforming to the sensing result obtained by said second sensing means, wherein said control means does not activate said second sensing means until said first sensing means senses that the remaining amount of ink stored in said reservoir means is the predetermined amount.

17. The apparatus according to claim 16, wherein said recording means includes a recording head having:

an energy generating element for generating energy to jet ink droplets; and a jetting port for jetting the ink droplets.

18. The apparatus according to claim 17, wherein said energy generating element generates thermal energy causing a change of state of the ink, so that ink droplets are jetted from said jetting port.

19. An image recording apparatus comprising:

reservoir means for storing ink;

recording means for recording an image on a recording medium by jetting droplets of ink supplied from said reservoir means;

first sensing means for sensing a remaining amount of ink stored in said reservoir means, said first sensing means including counting means for counting an amount of ink used by said recording means and first discriminating means for discriminating the remaining amount of ink based upon the amount counted by said counting means;

second sensing means for sensing the remaining amount of ink stored in said reservoir means by determining a condition of the image recorded by said recording means, thereby obtaining a sensing result, said second sensing means including means for causing a prescribed pattern image to be recorded on the recording medium by said recording means, a sensor for sensing a recorded density of the prescribed pattern image and second discriminating means for discriminating the remaining amount of ink based upon the recorded density sensed by said sensor;

control means for controlling said second sensing means to sense the remaining amount of ink stored in said reservoir means after said first sensing means senses that the remaining amount of ink stored in said reservoir means is a predetermined amount; and output means for outputting information conforming to the sensing result obtained by said second sensing means, wherein said control means does not activate said second sensing means until said first sensing means senses that the remaining amount of ink stored in said reservoir means is the predetermined amount.

20. The apparatus according to claim 19, wherein said recording means includes a recording head having:

an energy generating element for generating energy to jet ink droplets; and a jetting port for jetting the ink droplets.

21. The apparatus according to claim 20, wherein said energy generating element generates thermal energy causing a change of state of the ink, so that ink droplets are jetted from said jetting port.

22. An image recording apparatus, comprising:

reservoir means for storing ink;

recording means for recording an image on a recording medium by jetting droplets of ink supplied from said reservoir means;

first sensing means for sensing an amount of consumption of ink;

second sensing means for sensing a remaining amount of ink stored in said reservoir means by determining a condition of the image recorded by said recording means, thereby obtaining a sensing result;

control means for controlling said second sensing means to sense the remaining amount of ink stored in said reservoir means after said first sensing means senses that the amount of consumption of ink is a predetermined amount; and output means for outputting information conforming to the sensing result obtained by said second sensing means, wherein said control means does not activate said second sensing means until said first sensing means senses that the amount of consumption of ink is the predetermined amount.

23. The apparatus according to claim 22, wherein said second sensing means includes:

means for causing a prescribed pattern image to be recorded on the recording medium by said recording means;

a sensor for sensing a recorded density of the prescribed pattern image; and discriminating means for discriminating the remaining amount of ink based upon the recorded density sensed by said sensor.

24. The apparatus according to claim 23, wherein the image is recorded on the recording medium in pages, each of said pages having a trailing edge portion, and after one page of the image has been recorded, said recording means records the prescribed pattern image on the trailing edge portion of the recording medium on which said one page of the image has been recorded.

25. The apparatus according to claim 24, wherein said recording means includes a recording head having:

an energy generating means for generating energy to jet ink droplets; and a jetting port for jetting the ink droplets.

26. The apparatus according to claim 25, wherein said energy generating means generates thermal energy causing a change of state of the ink, so that ink droplets are jetted from said jetting port.

27. The apparatus according to claim 23, wherein said recording means includes a recording head having:

an energy generating means for generating energy to jet ink droplets; and a jetting port for jetting the ink droplets.

28. The apparatus according to claim 27, wherein said energy generating means generates thermal energy causing a change of state of the ink, so that ink droplets are jetted from said jetting port.

29. The apparatus according to claim 22, wherein said first sensing means includes:

counting means for counting an amount of ink used by said recording means; and discriminating means for discriminating the amount of consumption of ink based upon a count value produced by said counting means.

30. The apparatus according to claim 29, wherein said recording means includes a recording head having:

an energy generating means for generating energy to jet ink droplets; and a jetting port for jetting the ink droplets.

31. The apparatus according to claim 30, wherein said energy generating means generates thermal energy causing a change of state of the ink, so that ink droplets are jetted from said jetting port.

32. The apparatus according to claim 22, wherein said recording means includes a recording head having:

an energy generating element for generating energy to jet ink droplets; and a jetting port for jetting the ink droplets.

33. The apparatus according to claim 32, wherein said energy generating element generates thermal energy causing a change of state of the ink, so that the ink droplets are jetted from said jetting port.

* * * * *

UNITED STATES PATENT AND TRADEMARK OFFICE

CERTIFICATE OF CORRECTION

PATENT NO. : 5,798,771

DATED : August 25, 1998

INVENTOR(S) : Teruyuki Nishii and Norio Sugiyama

It is certified that error appears in the above-identified patent and that said Letters Patent is hereby corrected as shown below:

COLUMN 4

Line 28, after "of" insert --the--.

COLUMN 5

Line 12, after "has" insert --been--.

COLUMN 7

Line 32, after "capable" insert --of--.

COLUMN 11

Line 26, change "53*b*" to --53*b*'--.

COLUMN 15

Line 59, change "letting" to --jetting--.

UNITED STATES PATENT AND TRADEMARK OFFICE

CERTIFICATE OF CORRECTION

PATENT NO. : 5,798,771

DATED : August 25, 1998

INVENTOR(S) : Teruyuki Nishii and Norio Sugiyama

It is certified that error appears in the above-identified patent and that said Letters Patent is hereby corrected as shown below:

COLUMN 16

Line 2, change "letting" to --jetting--;

Line 8, change "a with" to --with a--; and

Line 32, change "letting" to --jetting--.

Signed and Sealed this

Eighteenth Day of January, 2000

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 5,798,771

DATED : August 25, 1998

INVENTOR(S) : Teruyuki Nishii and Norio Sugiyama

It is certified that error appears in the above-identified patent and that said Letters Patent is hereby corrected as shown below:

On the title page,

Under [56], References Cited, U.S. Patent Documents, insert --

| | | | |
|---|---|---|---|
| 4,558,333 | 12/1985 | Sugitani et al . . . | 346/140 R |
| 4,740,796 | 4/1988 | Endo et al . . . . . | 346/1.1 |
| 4,723,129 | 2/1988 | Endo et al . . . . . | 346/1.1 |
| 5,132,711 | 7/1992 | Shinada et al. . . . | 346/140 |
| 5,172,140 | 12/1992 | Hirabayashi et al. . | 346/140 R |
| 5,189,521 | 2/1993 | Ohtsubo et al. . . . | 358/296-- |

Under [56], Foreign Patent Documents, insert --

| | | |
|---|---|---|
| 59-123670 | 7/1984 | Japan . . . . . --. |

Signed and Sealed this

Twelfth Day of September, 2000

*Attest:*

Q. TODD DICKINSON

*Attesting Officer*

*Director of Patents and Trademarks*